US005542223A

United States Patent [19]

Inda et al.

[11] Patent Number: 5,542,223

[45] Date of Patent: Aug. 6, 1996

[54] AIR DUCT BOOT

[75] Inventors: John P. Inda, Shawnee; Joseph J. Inda, Tecumseh, both of Okla.

[73] Assignee: General Plastics, Inc., Shawnee, Okla.

[21] Appl. No.: 109,433

[22] Filed: Aug. 20, 1993

[51] Int. Cl.[6] ..... E04B 1/70

[52] U.S. Cl. ..... 52/302.1; 52/302.3; 454/289

[58] Field of Search ..... 52/302.1, 302.3, 52/220.1; 285/424; 454/270, 271, 289

[56] References Cited

U.S. PATENT DOCUMENTS

| | | | |
|---|---|---|---|
| 24,660 | 7/1859 | Potts . | |
| D. 314,820 | 2/1991 | Sullivan | D23/393 |
| 925,762 | 6/1909 | Eager . | |
| 2,086,007 | 7/1937 | Tompkins | 285/105 |
| 2,215,318 | 9/1940 | Bristol | 138/75 |
| 2,297,179 | 9/1942 | Walker | 72/16 |
| 2,335,906 | 10/1943 | Blinn | 72/16 |
| 2,348,148 | 5/1944 | Rankin | 454/271 |
| 3,220,079 | 11/1965 | Aggson | 454/271 X |
| 3,677,517 | 7/1972 | Root et al. | 285/424 X |
| 4,261,598 | 4/1981 | Cornwall | 285/56 |
| 4,499,332 | 2/1985 | Shea et al. | 174/48 |
| 4,619,471 | 10/1986 | Harbeke | 285/158 |
| 4,623,170 | 11/1986 | Cornwall | 285/4 |
| 4,773,197 | 9/1988 | Sullivan | 52/221 |
| 4,781,401 | 11/1988 | Sharp | 285/424 X |

FOREIGN PATENT DOCUMENTS

| | | | |
|---|---|---|---|
| 0315943 | 5/1989 | European Pat. Off. | 454/289 |
| 13301485 | 5/1963 | France | 454/271 |

*Primary Examiner*—Lanna Mai

*Attorney, Agent, or Firm*—Dougherty, Hessin, Beavers & Gilbert

[57] ABSTRACT

An air duct boot useful for connecting a heating and air conditioning duct to an air register grate to permit air to be circulated into a space to be heated or cooled. The air duct boot includes a housing of right parallelepiped configuration constructed of a synthetic resin and having an internal support for preventing excessive deflection of opposed walls of the housing when concrete is poured therearound. Reinforcing ribs are molded into the opposed walls. The housing also includes an integrally molded top or upper portion which can be quickly and easily removed after the boot is installed in a concrete pad or other foundation structure. A protuberant, generally cylindrical neck portion extends from one side of the housing near its lower end for connection to the duct. The entire air duct boot is molded as an integral unit.

23 Claims, 1 Drawing Sheet

AIR DUCT BOOT

BACKGROUND OF THE INVENTION

1. Field of the Invention

This invention relates to fittings used in the ducting of central heating and air conditioning systems, and more particularly, to an air duct boot utilized to terminate ducting in an air register located at the air discharge location.

2. Description of the Prior Art

In the construction of buildings which are to be provided with central heating and air conditioning, a network of ducts is extended from a central source of heat or cool air into the various rooms for discharging the heated or cooled air into the rooms. At the ground level, these ducts are frequently laid horizontally with or beneath a slab or pad from the central location where the cooling or heating of the air is developed. The ducts then terminate in short, vertically extending legs which end at the surface of the floor within the particular room where the air is to be discharged. In reaching this location, the short, vertical leg of the duct, which may be referred to as a boot, ends at its upper terminus at approximately floor level in an opening surrounded by a round or rectangular portion of the material of which the duct is constructed. At this location, an air register or grate is fitted over or into the upper end of the boot to prevent various objects from falling into the boot and air duct.

One type of air duct boot which has been utilized as a metallic (usually sheet metal) housing having an open lower end and an open upper end, with the lower end being disposed in the sand upon which the pad or slab for the building is laid.

U. S. Pat. No. 4,623,170 to Cornwall, discloses a synthetic resin coupling sleeve which can be positioned in a concrete slab or other foundation structure, and which facilitates the securement of a pipe into and through the concrete. The coupling is of cylindrical form and includes a plurality of concentric external rings which facilitate cutting the sleeve or coupling off at a desired location even with the top surface of the concrete which is to be poured. The coupling is opened at both the lower end and the upper end.

U.S. Pat. No. 4,773,197 to Sullivan, assigned to the assignee of the present invention, discloses a synthetic resin air duct boot which is used for connecting an air duct laid in or beneath a slab for a building to a grill or air register by which the air from the duct is circulated into a room or enclosed space. The air duct boot of Sullivan includes a housing which is of generally right parallelepiped configuration, and includes substantially horizontally extending bottom and top walls interconnected by side walls. A protuberant rib extends around the housing near the top wall, and defines a location at which a portion of the housing may be easily removed after the air duct boot has been placed in position, and a concrete slab or pad has been poured to a selected level adjacent to the top of the boot housing. The housing has a generally cylindrical neck which projects outwardly therefrom in a horizontal direction. The cylindrical neck is molded integrally with the housing and includes an outer annular flange portion which is adjacent to an annular shoulder near the free outer end of the circular neck. The annular flange portion and the adjacent annular shoulder form a situs for the location of an O-ring sealing element or other suitable sealing gasket. The end of the tubular air duct can be pressed over the cylindrical neck of the air duct boot, and the O-ring or gasket will form a seal with the interior surface of the duct.

The above-described air duct of Sullivan has worked well, but the structure thereof includes relatively large sections of unsupported planar walls. In the pouring of concrete, inward deflection of these walls may result. If the walls are deflected too far inwardly, there is a possibility of rupture. The present invention solves this problem by providing external ribs and an internal support for the walls which is integrally molded with the structure.

SUMMARY OF THE INVENTION

The present invention is a synthetic resin air duct boot which is used for connecting an air duct laid in or beneath a slab for a building to a grill or air register by which air from the duct is circulated into a room or enclosed space. The air duct boot provides internal support for opposite walls thereof and can be quickly, easily and relatively inexpensively manufactured. The air duct boot also provides certain advantages over the type of metallic structures which have been predominantly used for this air conveyance purpose in the past.

When installed, an internal support of the air duct boot prevents concrete which is poured therearound from damage as a result of excessive inward deflection of the walls of the air duct boot. External ribs also act to stiffen the walls.

After installation in the concrete, a portion of the housing can be easily removed, and the interior of the housing opened at that time. An air register grill can be secured in place over the top of the housing in order to facilitate the passage of air into a room or confined space in accordance with conventional air conditioning and heating principles.

Briefly described, the air duct boot of the present invention includes a housing which is of generally right parallelepiped configuration, and includes substantially horizontally extending bottom and top walls interconnected by side walls. A pair of relatively large side walls are internally supported by a molded internal support which prevents excessive inward deflection of the planar side walls. Molded ribs in the side wall provide stiffness therefor.

An important object of the invention is to provide an air duct boot which is structurally strong and has a sufficient support to retain its shape, even when the upper portion of the boot is initially surrounded by uncured concrete.

Another object of the invention is to provide an air duct boot which is an integrally molded synthetic resin unit having a closed bottom end which prevents water from entering the boot from below after the boot is installed with its lower end located in the sand fill which underlies a building pad or slab in which the upper portion of the boot is positioned and in which the upper portion has an integral support for preventing damaging deflection of the upper portion when concrete is poured therearound.

Additional objects and advantages of the invention will become apparent as the following detailed description of the preferred embodiment is read in conjunction with the drawings which illustrate such embodiment.

DESCRIPTION OF THE PREFERRED EMBODIMENT

Figure 1:
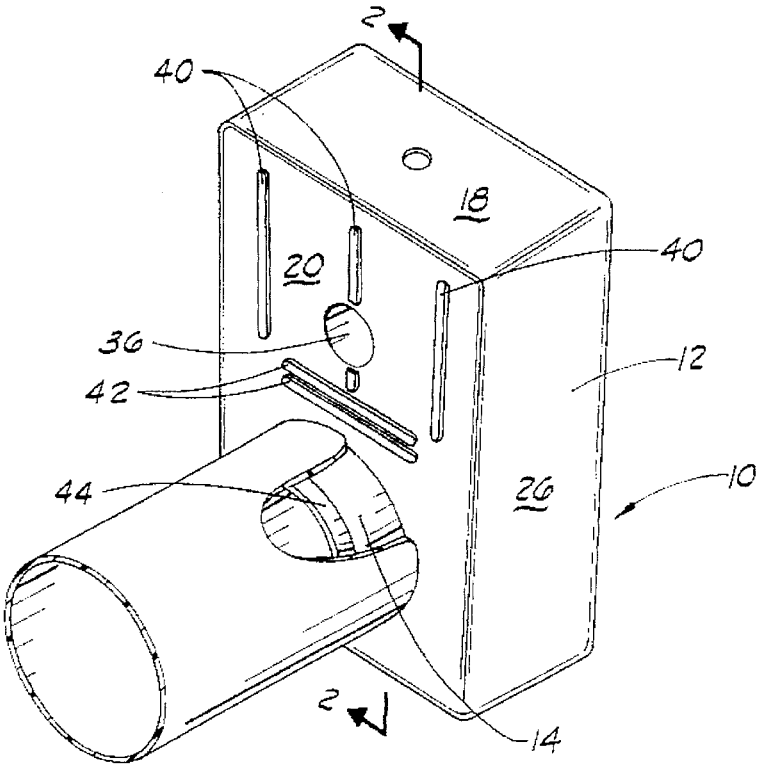
FIG. 1 shows a perspective view of a preferred embodiment of the air duct boot of the present invention.

Referring now to the drawings, and more particularly to FIG. 1, the air duct boot of the present invention is shown and generally designated by the numeral 10. Air duct boot 10 includes a housing 12 which has a generally cylindrical tubular neck 14 projecting from one side of the housing.

Figure 2:
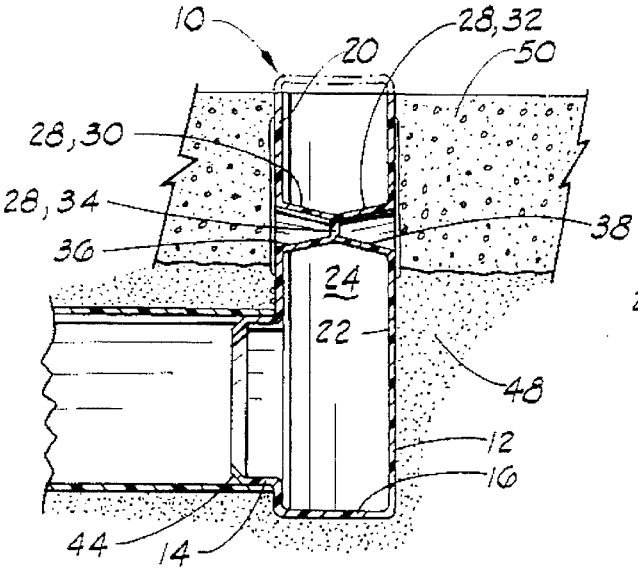
FIG. 2 is a sectional view taken along lines 2—2 of FIG. 1, and illustrating, in addition to the section through the air duct boot and the air duct connected thereto, the surrounding fill sand and concrete slab or pad poured therearound.
Figure 3:
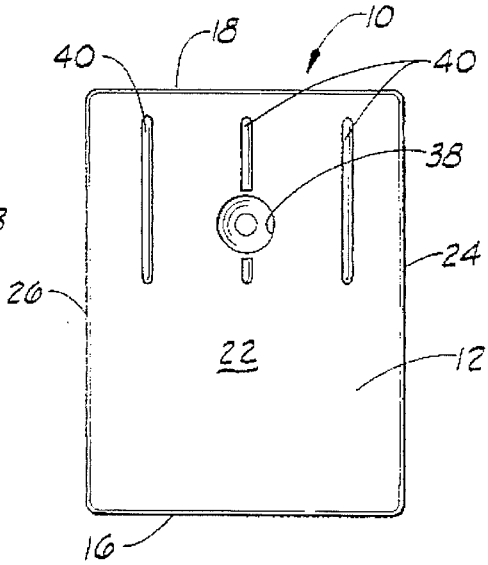
FIG. 3 is a rear elevational view of the air duct boot.

Referring now also to FIG. 2, housing 12 is of generally right parallelepiped configuration and includes a flat, substantially horizontally extending bottom wall 16 and a flat, substantially horizontally extending top wall 18 which extends parallel to the bottom wall. The housing further includes parallel front and back walls 20 and 22, respectively, and a pair of opposed narrow, parallel side walls 24 and 26. Side walls 24 and 26, of course, extend between and interconnect bottom and top walls 16 and 18, as do front and back walls 20 and 22.

An internal support 28 extends through hollow housing 12 and between front and back walls 20 and 22. In the integrally molded embodiment shown, support 28 is formed by a front conical portion 30 extending inwardly from front wall 20 and a rear conical portion 32 extending inwardly from rear wall 22. A web 34 divides conical portions 30 and 32. It will be seen that internal support 28 thus defines a front opening 36 and a rear opening 38.

It should be understood that the configuration of internal support 28 shown herein is merely one preferred embodiment well adapted for molding. However, the exact shape and configuration of internal support 28 is not critical. The important feature is that internal support 28 extends from front wall 20 to rear wall 22, thereby providing continuous support therebetween. Web 34 acts as a strengthening member for support 28, but the invention is not intended to be limited to a support having such a web. For example, internal support 28 could define an opening all the way through air duct boot 10.

Housing 12, protuberant tubular neck or spout 14 and internal support 28 constitute an integrally molded unit formed from a suitable synthetic resin material, such as a polyvinyl chloride. Blow molding is one preferred procedure for use in forming this air duct boot. The generally cylindrical tubular neck 14 projects from front wall 20 of housing 12 and is spaced a relatively short distance above bottom wall 16 toward top wall 18.

A plurality of vertical reinforcing ribs 40 are molded into front and rear walls 20 and 22. Ribs 40 preferably extend slightly outwardly from front or rear walls 20 and 22 and provide stiffening therefor. It will be noticed that a centrally positioned rib 40 on front wall 20 is divided by a front opening 36, and similarly, a centrally located rib 40 on rear wall 22 is divided by rear opening 38.

Between vertical ribs 40 and neck 14, a plurality of horizontal ribs 42 are molded into front wall 20. Horizontal ribs 42 also preferably extend externally from front wall 20 and provide stiffening therefor. It will also be seen by those skilled in the art that horizontal ribs 42 provide reinforcement of front wall 20 adjacent to neck 14.

A chamfered corner 44 is formed on the axially outer free end of tubular neck 14. Tubular neck 14 is sized such that a cylindrical or tubular duct section 46 may be pressed thereon in the manner illustrated in the drawings, and chamfer 44 provides guidance as duct 36 is first positioned onto neck 14. As duct 36 is pressed onto neck 14, stiffening ribs 42 and internal support 36 prevent excessive inward deflection of front wall 20. Duct 36 may be affixed to neck 14 by any means known in the art, such as with a plastic adhesive.

In the use of air duct boot 10, it is first set at the location where it is intended to function as a riser extending from a horizontally projecting air duct section, upwardly to the surface of a floor within a room of a building to be heated or cooled. Air duct boot 10 is thus first connected to the open end of the duct section 46 by pressing the tubular neck 14 into the open end of the duct section as previously described. Air duct boot 10 is oriented in the manner illustrated in FIGS. 1 and 2 of the drawings, with the lower end portion of housing 12, including bottom wall 16, buried in the sand 48 which underlies slab or pad 50 in the finished construction. At this time, of course, sand 48 has not been filled completely to the level where slab 50 will be poured, but FIG. 2 illustrates the final operative position of duct section 46 and air duct boot 10.

It will be noted that at this time, the bottom of housing 12 is completely sealed against the ingress of any water which may seep up underneath the foundation of the structure built upon the slab which is a not infrequent occurrence. Thus, water cannot enter into the system conveying warm or cool air, or to the interior of the house, nor can any type of insects or vermin enter into the air conditioning duct work by entering an open lower end of the air duct boot 10. Being made of a chemically inert synthetic resin material, air duct boot 10 resists rusting or oxidation to a state which may ultimately permit leakage of water into the lower end of the air duct boot, and ingress thereinto by foreign matter or by insects.

After air duct boot 10 has been connected to the free end of the duct section 46, filling of sand 48 around the interconnected duct and duct boot continues until the surface of the sand reaches the level where it is desired to pour slab or pad 50. Housing 12 has been purposely dimensioned so that the housing will extend above the upper surface of floor or slab 50 after it is poured, as shown in phantom lines in FIG. 2. This permits an adequate exposed amount of housing 12 to permit a portion of the housing (that shown in phantom lines in FIG. 2) to be cut away and a suitable air register grill to be fitted to the now open upper end of the housing.

As the uncured concrete is poured around the upper portion of housing 12, support 28 prevents undesired inward deflection, due to the weight of the concrete, of large, planar front and back walls 20 and 22. Ribs 40 and 42 provide additional stiffening for front and back walls 20 and 22. Excessive inward deflection of front and back walls 20 and 22 may cause the structure to tear or break which would allow the concrete to enter housing 12. Even if the walls do not break, air flow through air duct 10 could be restricted by the reduced cross-sectional area. Obviously, these would be undesirable results.

An additional benefit of support 28 is that front and rear openings 36 and 38 defined thereby will fill with concrete as slab 50 is poured. Those skilled in the art will thus see that housing 12 of air duct boot 10 is thus grouted into concrete slab 50 which aids in preventing later movement of the slab as the building structure settles over time. Ribs 40 also provide some grout-like support for housing 12. This grouting action of internal support 28 and ribs 40 thus prevents any significant movement of air duct boot 10 within slab 50.

Ribs 40 and 42 also function as reinforcing elements which greatly enhances the strength of the upper portion of the housing 12, so that the housing can better withstand, without distortion, the compressive forces exerted on it as the concrete is poured to form the slab. The strength imparted to the upper portion of housing 10 by ribs 40 and 42 also facilitates the cutting away of a portion of the housing above the slab after the slab has been poured.

After the upper portion of the housing 12 has been removed, an air register structure is secured to the free upper edge of housing 12 in accordance with conventional securement techniques presently used in the art.

From the foregoing description of the invention, it will be perceived that the present invention provides an improved air duct boot which can be easily formed, is easily installed by virtue of being an integrally formed unit, has an extended service life by reason of having a closed bottom which prevents water from entering the air conditioning system, has adequate support which prevents excessive inward deflection of the large front and back walls thereof, and which facilitates installation of an air register grill on the upper end thereof after the connection of the duct of the air conditioning system has been completed and the slab has been poured.

Although the drawings and description which are here set forth function to describe, for illustrative purposes, the manner in which a preferred embodiment of the invention is to be constructed, it will be understood that various changes and innovations in the illustrated and described air duct boot structure can be effected by continuing to rely upon the basic and fundamental principles upon which this invention is bottomed, and which are believed to be new. All such changes and innovations are encompassed within the scope and spirit of the appended claims.

What is claimed is:

1. An air duct boot for interconnecting, and extension between, a subfloor section of air conditioning and heating duct and an air register grill, said air duct boot comprising:

a synthetic resin tubular housing comprising:

an upper end;

a lower end;

an integrally molded synthetic resin top wall closing the upper end of the housing;

an integrally molded synthetic resin bottom wall closing the lower end of the housing;

an integrally molded synthetic resin front wall extending across the front of the housing; and an integrally molded synthetic resin back wall extending across the back of the housing; an integrally molded internal support extending between said front and back walls for providing substantially continuous support between said front end back walls, said support defining a pair of opposed openings; and a web disposed between said openings and preventing communication between said openings.

2. The air duct boot of claim 1 further comprising a tubular synthetic resin neck formed integrally with the housing and projecting horizontally outwardly from the side of the housing at a location relatively near said bottom wall of the housing and to said top wall thereof.

3. The air duct boot of claim 2 wherein said support is positioned above said neck.

4. The air duct boot of claim 2 wherein said tubular neck is further characterized as having a chamfered end.

5. The air duct boot of claim 2 wherein:

said housing is of right parallelepiped configuration; and said tubular neck is of substantially cylindrical configuration.

6. The air duct boot of claim 1 wherein said support defines an opening therein.

7. The air duct boot of claim 1 wherein said support has an internal strengthening web molded therein.

8. The air duct boot of claim 1 further comprising a reinforcing rib molded into at least one of said front and back walls.

9. The air duct boot of claim 8 wherein said rib extends externally from said one of said front and back walls.

10. A system for conveying air from a source to a point of discharge, said system comprising:

a bed of sand;

a concrete slab overlying the sand and having a level, horizontal upper surface;

a cylindrical, horizontally extending duct having an open end and overlain by the concrete in said slab; and a synthetic air duct boot connected to the open end of said duct and having a lower end portion in said sand and an upper portion in said slab, said air duct boot comprising:

a hollow housing having a closed lower end buried in the sand and having a closed upper end above the upper surface of said concrete slab and further having a pair of opposite walls extending between said upper and lower ends;

an internal support extending between said walls for providing support therefor as said concrete is poured to form said slab, said support defining an opening therein such that as said concrete is poured to form said slab, a portion of said concrete enters said opening, thereby acting to grout said housing in said slab when said concrete cures; and a cylindrical tubular neck projecting horizontally outwardly from said housing at a location below said support member, said tubular neck projecting into the open end of said duct to convey air from the interior of the duct to the interior of the housing.

11. The system of claim 10 wherein said opening is one of a pair of said openings separated by a web molded in said support member.

12. The system of claim 10 wherein said support has a strengthening rib molded there.

13. The system of claim 10 wherein said support is integrally molded with said walls.

14. The system of claim 12 wherein at least one of said opposite walls has a stiffening rib molded therein.

15. The system of claim 10 wherein said opposite walls have a plurality of vertical reinforcing ribs molded therein.

16. The system of claim 15 wherein at least one of said opposite walls has a horizontal reinforcing rib molded therein.

17. A system for conveying air from a source to a point of discharge, said system comprising:

a bed of sand;

a concrete slab overlying the sand and having a level, horizontal upper surface;

a cylindrical, horizontally extending duct having an open end and overlain by the concrete in said slab; and a synthetic air duct boot connected to the open end of said duct and having a lower end portion in said sand and an upper portion in said slab, said air duct boot comprising:

a hollow housing having a closed lower end buried in the sand and having a closed upper end above the upper surface of said concrete slab and further having a pair of opposite walls extending between said upper and lower ends;

an internal support extending between said walls for providing support therefor as said concrete is poured to form said slab, said internal support comprising a pair of conical sections, each of said conical sections extending inwardly from corresponding opposite walls; and a cylindrical tubular neck extending horizontally outwardly from said housing at a location below said support member, said tubular neck projecting into the open end of said duct to convey air from the interior of the duct to the interior of the housing.

18. The system of claim 17 wherein said conical portions are divided by a web.

19. The system of claim 17 wherein said support has a strengthening rib molded therein.

20. The system of claim 17 wherein said support is integrally molded with said walls.

21. The system of claim 17 wherein at least one of said opposite walls has a stiffening rib molded therein.

22. The system of claim 17 wherein said opposite walls have a plurality of vertical reinforcing ribs molded therein.

23. The system of claim 22 wherein at least one of said opposite walls has a horizontal reinforcing rib molded therein.

* * * * *

UNITED STATES PATENT AND TRADEMARK OFFICE

CERTIFICATE OF CORRECTION

PATENT NO. : 5,542,223

DATED : August 6, 1996

INVENTOR(S) : John P. Inda and Joseph J. Inda

It is certified that error appears in the above-indentified patent and that said Letters Patent is hereby corrected as shown below:

Column 5, line 42 (Claim 1, line 17) delete "end" and insert --and-- therefor.

Column 6,

Claim 14, line 1, delete "12" and insert --10-- therefor.

Signed and Sealed this

Fifteenth Day of October, 1996

Bruce Lehman

*Attest:*

BRUCE LEHMAN

*Attesting Officer*

*Commissioner of Patents and Trademarks*